United States Patent [19]

Ziomek

[11] Patent Number: 4,533,334

[45] Date of Patent: Aug. 6, 1985

[54] TOW LINE HANDLE

[76] Inventor: Joseph F. Ziomek, 3236 Pine Lake Rd., West Bloomfield, Mich. 48033

[21] Appl. No.: 650,557

[22] Filed: Sep. 13, 1984

Related U.S. Application Data

[63] Continuation of Ser. No. 444,831, Nov. 26, 1982, abandoned.

[51] Int. Cl.[3] ..... B63B 21/56

[52] U.S. Cl. ..... 441/69

[58] Field of Search ..... 441/69; 114/253; D8/303, 305, 313, 315, 317

[56] References Cited

U.S. PATENT DOCUMENTS

| | | | |
|---|---|---|---|
| 2,561,760 | 7/1951 | Stifter | 46/77 |
| 2,998,797 | 9/1961 | Risney | 441/69 |
| 3,148,655 | 9/1964 | Brant | 441/69 |
| 4,038,719 | 8/1977 | Bennett | 16/110 R |
| 4,043,290 | 8/1977 | Holland | 441/69 |
| 4,280,240 | 7/1981 | Neuscheler . | |

*Primary Examiner*—Trygve M. Blix

*Assistant Examiner*—Edwin L. Swinehart

*Attorney, Agent, or Firm*—Yount & Tarolli

[57] ABSTRACT

An improved handle for towing a person, such as a water skier, has a configuration which matches the natural shape of the grip of human hands as they hold the handle. The handle includes an upwardly and forwardly sloping lower section which is engaged by one hand of the skier. An upper section of the handle also slopes upwardly and forwardly and is engaged by the other hand of the skier. The upper and lower sections of the handle are interconnected by a connector section which extends rearwardly from an upper end of the lower section of the handle to the lower end of the upper section of the handle. This results in the upper and lower sections of the handle being offset so that the hands of the skier are disposed with the palm of one hand on a first side of the handle and a palm of the other hand on the opposite side of the handle. Due to the natural orientation of the palm of the upper hand of the skier when he is gripping the handle, the upper section of the handle slopes forwardly to a greater extent than the lower section of the handle.

8 Claims, 5 Drawing Figures

TOW LINE HANDLE

This is a continuation of co-pending application Ser. No. 444,831 filed on Nov. 26, 1982 now abandoned.

BACKGROUND OF THE INVENTION

The present invention relates to a new and improved handle which is adapted to be manually gripped by a person being towed, such as a water skier.

Water skiers have commonly gripped a straight bar having its ends connected with a tow rope. The linear configuration of the bar has resulted in the skier's hands being in an unnatural position when they grip the bar. This unnatural orientation of the hands while gripping the bar results in the application of unnecessary and excessive stresses to the muscles of the skier.

Tow line handles for water skiers have also been made with a generally V-shaped configuration. The hands of the skier grip the transversely extending legs of the V-shaped handle. A tow line handle having a generally V-shaped configuration is shown in U.S. Pat. No. 4,280,240.

When a handle having a V-shaped configuration is gripped in a horizontal orientation, the palms of the skier's hands face downwardly with the skier's thumbs adjacent to the central portion of the handle. When a V-shaped handle is gripped in this manner, both legs of the handle apply an excessive force to the third and fourth fingers of the skiers hands. If the V-shaped handle is gripped in an upright orientation with the palms of the skier's hands on opposite sides of the handle, the third and fourth fingers of the hand which engages the upwardly and rearwardly sloping lower section of the handle will be subjected to excessive forces. The application of excessive force to any of the fingers of a skier's hand tends to promote fatigue and reduce the total force which can be transmitted between skier and the tow line.

SUMMARY OF THE PRESENT INVENTION

The present invention provides a tow line handle which is configured to match the hand and arm angle of a person being towed. This maximizes the efficiency of the towing operation and minimizes the fatigue of the person being towed. Although such a handle can be used for towing people in many different situations, it is believed that the handle will be particularly advantageous in water skiing, including both recreational and competition skiing.

The improved handle is adapted to be gripped in a generally upright orientation by a person who is being towed. The handle has two distinct sections, that is an upper section which is gripped by one hand and a lower section which is gripped by the other hand. Both the upper and lower sections of the handle slope upwardly and forwardly. Since each hand of a person being towed engages an upwardly and forwardly sloping section of the handle, the hands are in a natural orientation which minimizes the stress applied to the hand and arm muscles of the person being towed. In order to conform to the natural orientation of the hands when gripping the handle in front of the person, the lower section of the handle slopes upwardly and forwardly at a smaller angle than does the upper section of the handle.

Accordingly, it is an object of this invention to provide a new and improved tow line handle having a configuration to match the hand and arm angles of a person being towed to thereby maximize the efficiency of the towing operation and minimize fatigue of the person being towed.

Another object of this invention is to provide a new and improved tow line handle having upwardly and forwardly sloping upper and lower sections which are engaged by the hands of a person being towed.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 2:
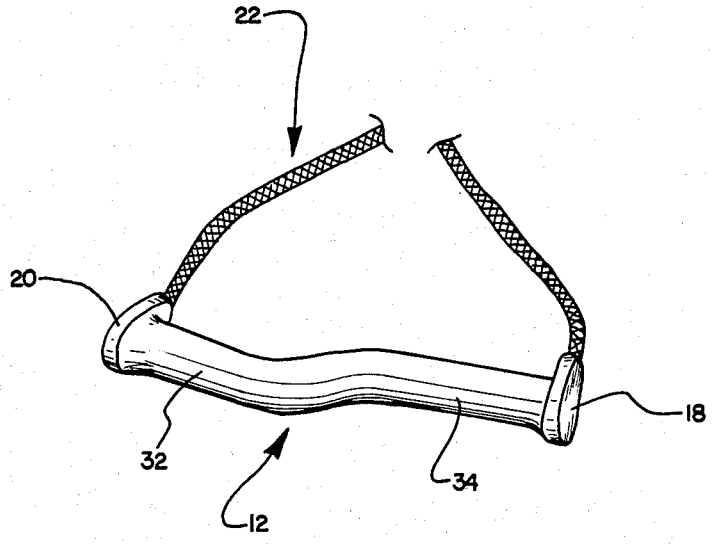
FIG. 2 is a pictorial illustration of a tow line handle constructed in accordance with the present invention.

When a person 10, such as a water skier, is being towed, he grips a handle 12 which is held in front of him and is connected with a tow line 14. The lower and upper ends 18 and 20 of the handle 12 (FIG. 2) are connected with the tow line 14 by a rope bridle 22. The tow line 14 is connected with a vehicle, that is a boat in the case of a water skier. However, it should be understood that the handle 12 can be used in towing people from many different types of vehicles and in many different environments.

Figure 1:
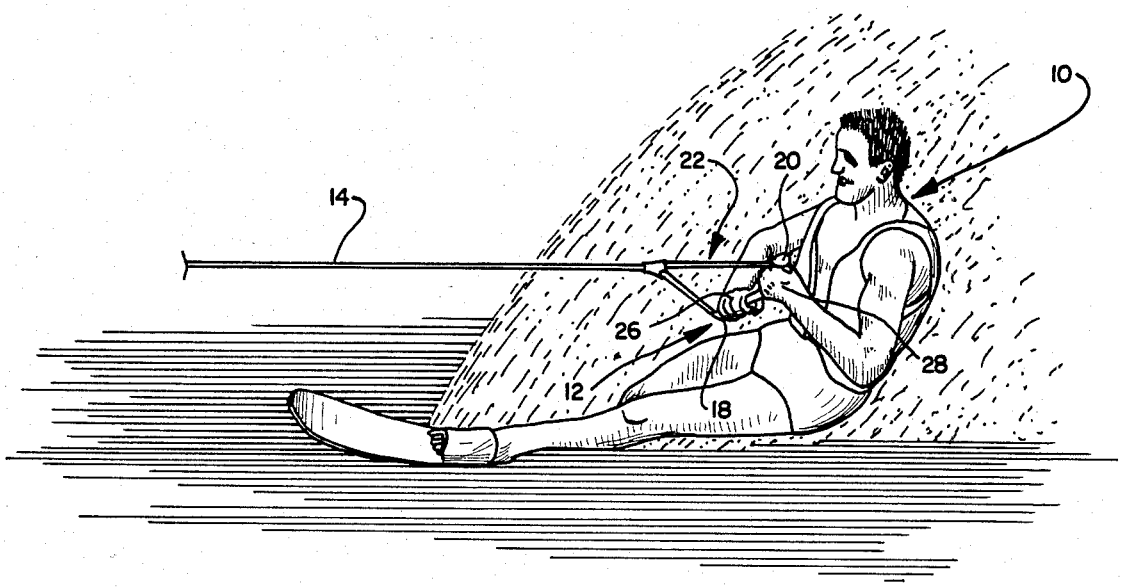
FIG. 1 is a pictorial illustration of a person being towed.

In order to minimize skier fatigue and to maximize performance and the efficiency of the towing operation, the handle 12 has a configuration which matches the natural grip of the hands of the skier as he holds the handle. The skier 10 holds the handle 12 in a generally upright orientation. His hands grip the handle in a manner similar to that in which a baseball bat is gripped. Thus, one hand of the skier is disposed above the other hand. For the skier shown in FIG. 1, the left hand is disposed above the righthand. If the skier 10 prefers, the right hand can be disposed above the left hand. The handle 12 can be used equally well by either right or left handed skiers.

The handle 12 is tilted toward the uppermost placed hand of the skier. Thus, the handle 12 is tilted toward the left in FIG. 1 so that the upper end 20 of the handle is at approximately the 10 o'clock position as viewed by the skier 10. If the skier 10 places his right hand uppermost, the handle 12 would be tilted toward the right with the upper end 20 of the handle at approximately the 2 o'clock position. Although the orientation of the handle is moved from this position during the performance of skiing maneuvers, the natural characteristics of the skier's body tend to cause him to return the handle 12 to this position while skiing straight ahead.

Due to the physical characteristics of the human body, the clenched right and left hands 26 and 28 of the skier 10 naturally tend to grip the handle 12 with the fingers curled about axes which slope forwardly and upwardly. Thus, during towing of the skier 10, the lower hand 26 naturally assumes a position in which a shaft held by the hand would slope upwardly and forwardly toward the boat pulling the skier. Similarly, a shaft gripped by the upper hand 28 would also slope upwardly and forwardly. The natural orientation of the arms of the skier during towing is such that the axis about which the fingers of the lower hand 26 are curled slopes forwardly and upwardly at a smaller angle to the vertical plane than does the axis about which the fingers of the upper hand 28 are curled.

Figure 3:
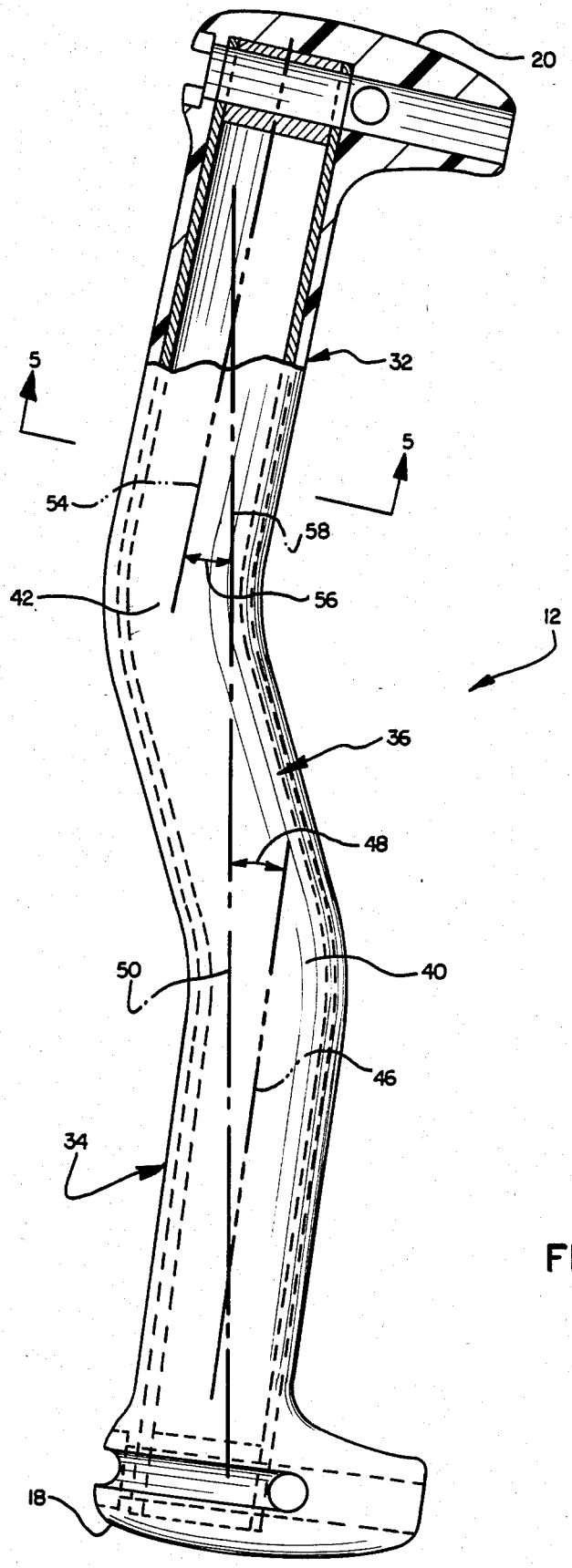
FIG. 3 is an enlarged, partially broken away, view of the tow line handle of FIG. 2.

In accordance with a feature of the present invention, the handle 12 has a configuration which matches the natural shape of the hands 26 and 28 as the skier 10 is towed. Thus, the handle 12 has a forwardly and upwardly sloping upper section 32 and a forwardly and upwardly sloping lower section 34 (see FIGS. 2 and 3). The upper and lower sections 32 and 34 are interconnected by an upwardly and rearwardly sloping connector section 36. The connector section 36 extends between an upper end 40 of the lower section 34 and a lower end 42 of the upper section 32 (see FIG. 3).

The lower section 34 of the handle 12 has a central axis 46 which is skewed at an acute angle 48 relative to a vertical axis 50. Similarly, the upper section 32 of the handle 12 has a central axis 54 which is skewed at an acute angle 56 relative to a vertical axis 58. The angles 48 and 56 each have a magnitude which is between 5 and 20 degrees. Of course, the angle 56 is greater than the angle 48 to accommodate the tendency for the fingers of the upper hand to curl about an axis which slopes to a greater extent than the axis about which the fingers of the lower hand curl.

Although it is not intended to be limited to any specific angles, in one embodiment of the invention, the angle 56 was approximately 11 degrees, while the angle 48 was approximately 6 degrees. Of course, the specific angle which is naturally assumed by the hands of people having different physiques will be different. Therefore, the handle 12 could, advantageously, be designed to have the upper and lower sections skewed to a vertical axis at angles which correspond to the physique of a particular person or group of people.

Figure 4:
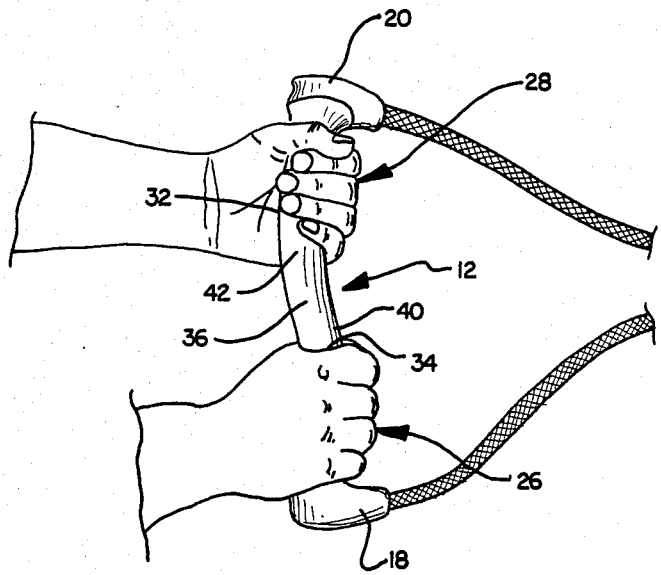
FIG. 4 is an illustration depicting the manner in which the tow line handle of FIG. 3 is gripped.

A skier 10 who prefers his left hand uppermost grips the handle 12 in the manner shown in FIG. 4. Thus, the right hand 26 of the skier grips the lower section 34 with the fourth (small) finger adjacent to the lower end 18 of the handle and with the first (index) finger and thumb adjacent to the upper end 40 of the lower section 34. The uppermost left hand 28 grips the upper section 32 of the handle 12 with the fourth (little) finger adjacent to the lower end 42 of the upper section 32 and the first (index) finger and thumb adjacent to the upper end 20 of the handle 12.

When the hands 26 and 28 grip the handle in the manner shown in FIG. 4, they are disposed in a normal or natural position which they would assume under the influence of the towing forces without being restrained by the handle 12. Thus, the axis about which the fingers of the lower right hand 26 are curled slopes upwardly and forwardly at a slightly smaller angle to the vertical plane than does the axis about which the fingers of the upper left hand are curled. Although the left hand 28 is disposed above the right hand 26, the handle 12 is tilted to the skier's left in the manner shown in FIG. 1. If the handle 12 was gripped by a right uppermost preferred hand, the right hand would engage the upper section 32 and the left hand would engage the lower section 34. The handle would then be tilted to the right rather than to the left.

Regardless of which hand of the skier is preferred, the palm of the two hands are disposed on opposite sides of the handle 12. Thus, the palm of the left hand is always disposed on the left side of the handle 12. The palm of the right hand is always disposed on the right side of the handle 12.

When the handle 12 is gripped in the manner shown in FIG. 4, the forces are distributed relatively evenly over the fingers of the skier's hands. Thus, the force applied against the first (index), second (middle), third (ring) and fourth (little) fingers of each hand are substantially equal. This is because there is no tendency for the skier's hands to move from the position shown in FIG. 4.

If the handle 12 was straight, the tendency for the skier's hands to tilt upwardly and forwardly would result in a relatively large percentage of the force being carried by the third and fourth fingers and a somewhat reduced force being carried by the first and second fingers. The unnatural orientation of a hand on a straight handle and the application of relatively large forces to the third and fourth fingers tends to excessively strain the muscles of the skier's forearms.

By having the configuration of the handle 12 match the natural shape of the human hands when they are being subjected to the forces necessary to tow a water skier, the strength of the skier's grip on the handle tends to be maximized and the fatigue of the skier arms minimized during recreational and/or competitive water skiing. By matching the configuration of the handle 12 to the human hands gripping the handle, the water skier may exceed his previous performance in terms of pull, force, speed, height capability, etc., due to more efficient utilization of the human capability.

Figure 5:
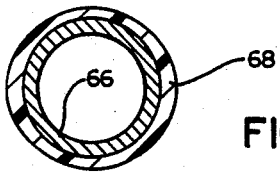
FIG. 5 is a sectional view, taken generally along the line 5—5 of FIG. 3, illustrating the cross sectional configuration of the tow line handle.

In order to further increase the conformance of the handle 12 to the configuration of the human hand, the handle advantageously has an oval cross sectional configuration (see FIG. 5). Thus, the handle 12 is formed with a structural core 66 having a circular cross sectional configuration. The core 66 is encased in an oval layer 68 of polymeric material. The resilient polymeric material cushions the skier's grip on the handle 12. The oval cross sectional configuration of the handle 12 enables the skier's fingers to readily curl around the handle in a natural manner.

In view of the foregoing description it is apparent that the present invention provides a tow line handle 12 which is configured to match the hand and arm angle of a person being towed. This maximizes the efficiency of the towing operation and minimizes the fatigue of the person being towed. Although such a handle can be used for towing people in many different situations, it is believed that the handle will be particularly advantageous in all forms of water skiing, including recreational, competition slalom, jumping, tricking and barefooting.

The improved handle 12 is adapted to be gripped in a generally upright orientation by a person who is being towed. The handle has two distinct sections, that is an upper section 32 which is gripped by one hand 28 and a lower section 34 which is gripped by the other hand 26. Both the upper and lower sections 32 and 34 of the handle 12 slope upwardly and forwardly. Since each hand of a person being towed engages an upwardly and forwardly sloping section of the handle, the hands are in a natural orientation which minimizes the stress applied to the hands and muscles of the person being towed. In order to conform to the natural orientation of the hands, the lower section 34 of the handle 12 slopes upwardly and forwardly at a smaller angle than does the upper section of the handle.

Having described one specific preferred embodiment of the invention, the following is claimed:

1. A tow line handle adapted to be manually gripped in a generally upright orientation by a person being towed in a forward direction, said handle comprising an upwardly and forwardly sloping lower section adapted to be engaged by one hand of the towed person with a thumb of the one hand upwardly and the fourth finger of the one hand downwardly, said lower section of said handle including a lower end portion having first means for engaging a portion of a tow line to provide for the application of force to said handle by the tow line at a location beneath the fourth finger of the one hand, an upwardly and forwardly sloping upper section adapted to be engaged by the other hand of the towed person with the thumb of the other hand upwardly and the fourth finger of the other hand downwardly adjacent to the thumb of the one hand, said upper section of said handle including an upper end portion having second means for engaging a portion of the tow line to provide for the application of force to said handle by the tow line at a location above the thumb of the other hand, and a connector section extending rearwardly from an upper end of said lower section to a lower end of said upper section to interconnect said upper and lower sections with the lower end of said upper section offset rearwardly of the upper end of said lower section so that the hands of the towed person are disposed with the palm of the one hand on a first side of said handle and the palm of the other hand on the opposite side of said handle and above the palm of the one hand, said connector section being disposed midway between said first and second means for engaging the tow line.

2. A handle as set forth in claim 1 wherein said upper and lower sections both slope upwardly and forwardly at angles between 5 and 20 degrees to a vertical plane.

3. A handle as set forth in claim 1, wherein said connector section slopes upwardly and rearwardly from said lower section to said upper section of said handle.

4. A handle as set forth in claim 1 wherein said upper and lower sections of said handle have a generally oval cross sectional configuration.

5. A handle as set forth in claim 1 wherein said lower section of said handle slopes upwardly and forwardly at a first angle to a vertical plane and said upper section of said handle slopes upwardly and forwardly at a second angle to the vertical plane, said first angle being smaller than said second angle.

6. A tow line handle adapted to be manually gripped in a generally upright orientation by a person being towed in a forward direction, said handle comprising an upwardly and forwardly sloping lower section adapted to be engaged by one hand of the towed person with the thumb of the one hand upwardly and the fourth finger of the one hand downwardly, an upwardly and forwardly sloping upper section adapted to be engaged by the other hand of the towed person with the thumb of the other hand upwardly and the fourth finger of the other hand downwardly adjacent to the thumb of the one hand, and a connector section extending rearwardly from an upper end of said lower section to a lower end of said upper section to interconnect said upper and lower sections with the lower end of said upper section offset rearwardly of the upper end of said lower section so that the hands of the towed person are disposed with the palm of the one hand on a first side of said handle and the palm of the other hand on the opposite side of said handle and above the palm of the one hand, said lower section of said handle sloping upwardly and forwardly at an acute angle relative to a vertical axis which extends through the center of the portion of the lower section of the handle engaged by the fourth finger of the one hand and through the center of the portion of the upper section of the handle engaged by the thumb of the other hand, said upper section of said handle sloping upwardly and forwardly at an acute angle relative to the vertical axis which extends through the center of the portion of the lower section of the handle engaged by the fourth finger of the one hand and through the center of the portion of the upper section of the handle engaged by the thumb of the other hand, said lower section of said handle including a lower end portion having first means for engaging a portion of a tow line to provide for the application of force to said handle by the tow line at a location beneath the fourth finger of the one hand, said upper section of said handle including an upper end portion having second means for engaging a portion of the tow line to provide for the application of force to said handle by the tow line at a loocation above the thumb of the other hand.

7. A handle as set forth in claim 6 wherein the vertical axis which extends through the center of the portion of the lower section of the handle engaged by the fourth finger of the one hand and through the center of the portion of the upper section of the handle engaged by the thumb of the other hand also extends through said connector section for at least a major portion of the length of said connector section.

8. A handle as set forth in claim 6 wherein said lower section of said handle slopes upwardly and forwardly at a first acute angle relative to the vertical axis and said upper section of said handle slopes upwardly and forwardly at a second acute angle relative to the vertical axis, said second acute angle being greater than said first acute angle to accommodate different natural orientations of the upper and lower hands.

* * * * *